US005829404A

United States Patent [19]

Mori et al.

[11] Patent Number: 5,829,404

[45] Date of Patent: Nov. 3, 1998

[54] CYLINDER HEAD FOR INTERNAL COMBUSTION ENGINE

[75] Inventors: Kazuhiko Mori; Taisuke Miyamoto, both of Okazaki; Kimihiko Ando; Kouta Kodama, both of Toyota, all of Japan

[73] Assignee: Toyota Jidosha Kabushiki Kaisha, Japan

[21] Appl. No.: 731,013

[22] Filed: Oct. 9, 1996

[30] Foreign Application Priority Data

Oct. 31, 1995 [JP] Japan ..... 7-282984

[51] Int. Cl.[6] ..... F01L 3/02

[52] U.S. Cl. ..... 123/188.8

[58] Field of Search ..... 123/188.8, 193.5, 123/193.3; 427/49, 423

[56] References Cited

U.S. PATENT DOCUMENTS

| | | | |
|---|---|---|---|
| 4,346,684 | 8/1982 | Vossieck | 123/188.8 |
| 4,422,875 | 12/1983 | Nakata et al. | 123/188.8 |
| 4,526,824 | 7/1985 | Dworak et al. . | |
| 4,546,737 | 10/1985 | Kazuoka et al. | 123/188.8 |
| 4,556,022 | 12/1985 | Yamada et al. | 123/188.8 |
| 4,661,371 | 4/1987 | Yamada et al. | 427/49 |
| 4,844,024 | 7/1989 | Fujiki et al. | 123/188.8 |
| 4,933,008 | 6/1990 | Fujiki et al . | 123/188.8 |
| 4,936,270 | 6/1990 | Ushio et al. | 123/188.8 |
| 5,031,878 | 7/1991 | Ishikawa et al. | 123/188.8 |

FOREIGN PATENT DOCUMENTS

| | | |
|---|---|---|
| 60-262954 | 12/1985 | Japan . |
| 1-95863 | 4/1989 | Japan . |
| 2-58444 | 12/1990 | Japan . |
| 3-10005 | 1/1991 | Japan . |
| 5-7911 | 2/1993 | Japan . |
| 6-58116 | 3/1994 | Japan . |
| 7-34965 | 2/1995 | Japan . |

OTHER PUBLICATIONS

"Material", Metal Engineering Society of Japan, vol. 33, No. 4(1994), pp. 429–431.

SAE Technical Paper Series No. 920571, "Development of Engine Valve Seats Directly Deposited onto Aluminum Cylinder Head by Laser Cladding Process", Minoru Kawasaki et al., Feb., 1992, pp. 1–15.

List of Prior Art Documents—Statement of Relevancy (2 pages).

Patent Abstracts of Japan, vol. 009, No. 279 (M–427), Nov. 7, 1985 of JP–A–60 122207

European Search Report dated Dec. 4, 1996 (3 pages).

Communication dated Dec. 19, 1996 (1 page).

*Primary Examiner*—Marguerite McMahon

*Attorney, Agent, or Firm*—Finnegan, Henderson, Farabow, Garrett & Dunner, L.L.P.

[57] ABSTRACT

A cylinder head for an internal combustion engine includes a metallic cylinder head body, and a valve seat. The cylinder head body is provided with an inlet port, and an outlet port which are opened and closed by an inlet valve, and an outlet valve, respectively. The valve seat is disposed at an end of the inlet port or the outlet port, has a contact surface which is contacted with and separated from the inlet valve or the outlet valve, and is formed of a laminated substance. The laminated substance is formed as flakes by thermal spraying particles in a predetermined depositing direction, and the contact surface is inclined by an angle of from 0 to 60 degrees with respect to the depositing direction. In the cylinder head, the valve seat is strongly bonded to the cylinder head body, exhibits improved frictional characteristics on the contact surface, and has such high thermal conductivity in a depth-wise direction that it can be readily cooled to a low temperature.

13 Claims, 10 Drawing Sheets

CYLINDER HEAD FOR INTERNAL COMBUSTION ENGINE

BACKGROUND OF THE INVENTION

1. Field of the Invention

The present invention relates to a cylinder head for an internal combustion engine. More particularly, it relates to a cylinder head including a valve seat which is formed by thermal spraying (including "HVOF" (i.e., High Velocity Oxi-Fuel) spraying) a thermal-spraying material, and with which an inlet valve or an outlet valve contacts.

2. Description of the Related Art

It has been recently necessary for automobile engines to satisfy both high-performance and low-fuel-consumption requirements simultaneously. Hence, automobile engines are expected to be subjected to much more severe thermal conditions.

Whereas, gasoline engines employ a cylinder head which is mostly made from an aluminum alloy. Moreover, in diesel engines, especially in small-sized diesel engines, it is a major trend to employ a cylinder head which is made from an aluminum alloy in order to reduce the weight of diesel engines, and to improve the heat efficiency thereof Cylinder heads are provided with valve seats which are in contact with an engine valve. Considering the heat resistance of valve seats and the wear resistance thereof, many aluminum-alloy cylinder heads employ valve seats into which a ferrous sintered alloy is press-fitted. However, these valve seats exhibit low heat conductivity, and tend to increase thermal load to engine valves, because the ferrous sintered alloy is simply press-fitted into the valve seats. To cope with these problems, the following countermeasures have been investigated: namely; substituting a high-alloy steel or Ni-based alloy for conventional materials for making engine valves; sealing Na in engine valves, and operating them as a heat pump for cooling the valve seats. However, these countermeasures create the following problems: it is difficult to decrease the temperature of engine valves; the inlet efficiency deteriorates; and the frequency of knocking increases.

On the other hand, when valve seats can be directly connected to aluminum-alloy cylinder heads, such a construction can cope with the increasing combustion temperature. In addition, the construction is expected to decrease the inlet temperature so as to improve the inlet efficiency; to decrease the temperature at valve seats so as to allow using materials of low grade for engine valves; to upgrade the anti-knocking characteristic; and to advance ignition-timing and so as to enhance the performance of automobile engines. Registered Japanese Patent No. 1,632,306 Japanese Examined Patent Publication (KOKOKU) No. 2-58,444), or a magazine published by the Metal Engineering Society of Japan ("MATERIAL", Vol. 33, No. 4 (1994), pp. 429–431) discloses a process for embodying the aforementioned idea. For instance, valve seats are prepared by melting and depositing a copper-based alloy on a cylinder head by using laser as a heating source. Since the copper-based alloy exhibits high thermal conductivity, the invention disclosed in these publications is expected to decrease the temperature at the valve seats. However, since the copper-based alloy has a melting point of about 1,000° C., there naturally exists a limitation on the heat-resistance improvement of valve seats which can be effected by the invention.

Moreover, in the process disclosed in the aforementioned publications, the copper-based alloy for making the valve seats is melted by irradiating a laser beam, thereby forming a pool of molten metal. In the meantime, a built-up metallic coating should be prepared. Accordingly, it is necessary to rotate a cylinder head, or to scan the laser beam at a high speed in order to inhibit the molten-metal pool from falling. As a result, the process is likely to complicate a processing system for carrying out the process itself considerably.

Japanese Unexamined Patent Publication (KOKAI) No. 7-34,965 discloses a valve-seat construction in which a ring-shaped iron-based sintered member is directly bonded to an aluminum-alloy-based substrate. Compared with conventional press-fitted valve seats, it is assumed that the valve seat thus constructed enables one to enlarge a diameter of engine valves. However, most of the valve seats should be processed by machining after the ring-shaped iron-based sintered member is bonded. Consequently, it is estimated that it takes long to complete the processing. In addition, during the processing, there is a fear for causing the ring-shaped iron-based sintered member to come off at the interface, because the ring-shaped iron-based sintered member is bonded to the aluminum-alloy-based substrate over a small bonding area.

Further, Japanese Unexamined Patent Publication (KOKAI) No. 1-95,863, Japanese Unexamined Utility Model Publication (KOKAI) No. 3-10,005, and Japanese Unexamined Patent Publication (KOKAI) No. 5-7,911 disclose a process for forming a valve seat by means of thermal spraying. According to these publications, a material (e.g., a powder, or a wire) is charged into a heat source to fuse, and the resulting molten material is spray-coated by a gaseous pressure onto a member to be thermal-sprayed.

In particular, according to Japanese Unexamined Patent Publication (KOKAI) No. 1-95,863, a valve seat is formed in the following manner: namely; a copper-based alloy is thermal-sprayed onto a core which is designed for forming a valve seat and is disposed in a mold for forming a cylinder head, and the resultant thermal-sprayed coating is covered by casting an aluminum alloy in the subsequent casting operation. It is presumed that this process produces a valve seat which exhibits good adhesion at the interface. However, an eutectic reaction takes place between the copper-based alloy and the aluminum elements at a relatively low temperature (e.g., at an eutectic temperature of 548° C.). Accordingly, it is anticipated that most of the molten metal forms Al—Cu alloy coatings in the casting operation. Moreover, it is foreseen that a considerable stress is exerted at the interface because of the heating in the casting operation, and because of the solidifying and shrinkage therein. In addition, the valve seat does not exhibit high heat resistance, because it is made from a copper-based alloy.

Furthermore, Japanese Unexamined Patent Publication (KOKAI) No. 3-10,005 discloses another cylinder head which is constructed by thermal spraying a ceramic material onto portions around a combustion chamber, in which a valve seat, an inlet port, and an outlet port are involved. Ceramic materials exhibit high heat resistance, but exhibit poor thermal conductivity which is generally much smaller than that of metallic materials. In conventional cylinder heads, however, the engine valves are cooled by thermally conducting about 60% of the heat, which is received by themselves, to the valve seats. Therefore, in the cylinder head disclosed in this publication, the resultant ceramics coating inhibits the heat from thermally conducting to the valve seats per se. Thus, it is contemplated that there is a concern for heating the engine valves to elevated temperatures and thereby turning them into heat spots.

In addition, Japanese Unexamined Patent Publication (KOKAI) No. 5-7,911 discloses a process for coating a chromium alloy by means of thermal spraying around the valve seats of combustion chambers and around the portions between the ports thereof. The chromium alloy can preferably be a Co—Cr alloy, or Ni—Co alloy. This process is developed in order to inhibit the bottom surface of cylinder heads from cracking at the portions between the ports of combustion chambers, and to improve the wear resistance around the valve seats. It is assumed that the process can upgrade the wear resistance of the valve seats satisfactorily. However, the thermal conductivity of the Co—Cr or Ni—Co alloy is one-tenth of that of aluminum, or one-third of that of carbon steel. As a result, it is not expected that the process will significally improve the cooling performance of cylinder heads, an improvement which results in upgrading the performance of engines.

As described so far, none of the prior arts disclose an arrangement which improves the cooling characteristic of valve seats in cylinder heads, and which simultaneously increases the degree of freedom in designing engine valves.

SUMMARY OF THE INVENTION

The present invention has been developed in view of the aforementioned circumstances. It is therefore an object of the present invention to provide a cylinder head which includes a valve seat of high thermal conductivity, and of good wear resistance, in order to improve the cooling characteristic of engines.

When a thermal-sprayed coating was formed by means of thermal spraying, the inventors of the present invention noticed that independent thermal-spraying particles collided with a substrate to be subjected to thermal spraying, and where thereby pressed and melt-deposited as thinned-out disks on the substrate. The inventors further determined that the thus pressed-and-thinned-out disks formed a thermal-sprayed coating, and that the ordinary sliding surface extended in the direction perpendicular to the depositing direction of the resulting thermal-sprayed coating. In other words, the inventors discovered that the surface of the independent thermal-spraying particles, which developed in the radial directions of the pressed-and-thinned-out disk, was utilized as the ordinary sliding surface. Hence, the inventors directed their attention to the cross-sectional surface of the thermal-sprayed coating which was prepared by cutting the thermal-sprayed coating in the depositing direction. Taking the coming-off resistance of the laminated independent thermal-sprayed particles into consideration, and also taking the number of independent thermal-sprayed particles appearing in a unit surface area of the cross-sectional surface into consideration, the inventors assumed that the wear resistance would be superb in the cross-sectional surface of the thermal-sprayed coating which was prepared by cutting the thermal-sprayed coating in the depositing direction, and that the friction coefficient would be stable therein. Moreover, the inventors estimated that the thermal-sprayed coating would exhibit low thermal conductivity in the depositing direction, but that it would exhibit high conductivity in the direction of the radially-developing thermal-spraying particles. The inventors verified these hypotheses by a series of experiments, and applied them to a valve seat of cylinder heads.

According to the present invention, a cylinder head for an internal combustion engine comprises:

a metallic cylinder head body provided with an inlet port, and an outlet port, the inlet port having opposite ends, and being opened and closed by an inlet valve, the outlet port having opposite ends, and being opened and closed by an outlet valve; and a valve seat disposed at one of the ends of at least one of the inlet port and the outlet port, having a contact surface being contacted with and separated from at least one of the inlet valve and the outlet valve, and formed of a laminated substance, the laminated substance formed as flakes by thermal spraying thermal-spraying particles in a predetermined depositing direction, the contact surface inclined by an angle of from 0 to 60 degrees with respect to the depositing direction.

In the present cylinder head, the contact surface of the valve seat is inclined by an angle of from 0 to 60 degrees with respect to the depositing direction of the laminated substance. Accordingly, on the contact surface, there are exposed the end surface of a large number of the deposited particles which are deposited in a flat manner. The more exposed end surfaces of the deposited particles, the more the frictional characteristic of the contact surface equalizes, and stabilizes. Further, the deposited particles extend in a depth-wise direction. Consequently, they are less likely to from the cylinder head body, and thereby the wear resistance of the contact surface can be improved. In addition, since the deposited particles develop in a depth-wise direction, the valve seat exhibits high thermal conductivity in the depth-wise direction. As a result, the heat received by the contact surface of the valve seat is likely to be conveyed to the cylinder head body, and thereby the valve seat can be readily cooled to a low temperature.

The present cylinder head for an internal combustion engine comprises a metallic cylinder head body, and a valve seat. The valve seat is alternately contacted with and separated from an engine valve, and is formed of a laminated substance. The laminated substance is deposited as flakes by thermal-spraying particles. The valve seat is alternately contacted with and separated from the engine valve at a contact surface which is inclined by an angle of from 0 to 60 degrees with respect to a predetermined depositing direction of the laminated substance.

When metallic particles are thermal-sprayed, they are at least partially fused. Then, together with a thermal-spraying flame, the metallic particles are emitted to a substrate, are collided with the surface of the substrate, are developed thereon, and are deposited thereon in a film-like manner. The metallic particles collided with the surface of the substrate one after another to deposit in a lamellar manner, and form the laminated substance. Thus, in the present cylinder head, the valve seat is constituted by the laminated substance which is deposited as flakes by thermal-spraying particles. Moreover, the laminated substance can be machined to form the contacting surface of the valve seat which is contacted with and separated from the engine valve. Accordingly, the end surface of the thus deposited independent thermal-spraying particles, constituting the laminated substance, is exposed on the contact surface.

The contact surface of the valve seat is inclined by an angle of from 0 to 60 degrees with respect to a predetermined depositing direction of the laminated substance. This arrangement exposes more of the end surfaces of the thermal-spraying particles which are deposited as flakes. For example, assume that a ratio of a diameter of a flaky thermal-spraying particle, constituting the laminated substance, with respect to a thickness thereof is 10 to 1 (i.e., 10:1), and that the number of the exposed end surfaces of the thermal-spraying particles is 1 when the contact surface is inclined by 90 degrees with respect to a predetermined depositing direction (i.e., when the contact surface develops in the flake-like extending direction of the thermal-spraying particles). When the contact surface is parallel to a predetermined direction: namely; when it is inclined by 0 degree with respect thereto, the number of the exposed end surfaces of the thermal-spraying particles is 10 in the same laminated substance; when it is inclined by 30 degrees with respect thereto, the number of the exposed end surfaces of the thermal-spraying particles is 8.5 in the same laminated substance; and when it is inclined by 60 degrees with respect thereto, the number of the exposed end surfaces of the thermal-spraying particles is 5 in the same laminated substance. Hence, in the present invention, the contact surface of the valve seat is inclined by an angle of from 0 to 60 degrees, preferably from 30 to 60 degrees, furthermore preferably from 40 to 50 degrees, with respect to a predetermined depositing direction of the laminated substance. As a result, a larger number of the end surfaces of the thermal-spraying particles can be exposed on the contact surface of the valve seat.

In the present cylinder head, the metallic cylinder head body can preferably formed of an aluminum alloy in order to reduce the weight of an internal combustion engine. When the metallic cylinder head body is made from an aluminum alloy, the valve seat can preferably be formed of at least one member selected from the group consisting of a carbon steel and an alloy steel whose matrix is hardened by martensitic transformation. The carbon steel or the alloy steel can resist the shock, the wear, and the seizure which take place when the engine valve is contacted with and separated from the valve seat. Therefore, the carbon steel or the alloy steel can further upgrade the performance of the present cylinder head.

Furthermore, the valve seat can preferably include a matrix which is formed of the carbon steel or the alloy steel, and at least one member selected from the group consisting of carbide and an iron-based compound. The carbide or the iron-based compound can preferably have an average particle diameter of 50 $\mu$m or less, further preferably from 10 to 40 $\mu$m, and can preferably be included in an amount of from 5 to 30% by volume. The carbide or the iron-based compound can furthermore enhance the wear resistance, and the seizure resistance of the valve seat.

Moreover, the valve seat can preferably include a matrix in which at least one member selected from the group consisting of aluminum and an aluminum alloy is included in an amount of from 10 to 30% by volume. The aluminum or the aluminum alloy can give the valve seat good thermal conductivity, and can simultaneously enhance the fused-adhesion of the valve seat to the metallic cylinder head body which is made from the aluminum or the aluminum-alloy. The aluminum alloy can preferably include Si in an amount of from 5 to 15% by weight, and the balance of Al, for example it can be an Al-12% Si alloy.

In addition, in the thus constructed valve seat of the present cylinder head, the aluminum or the aluminum alloy can preferably be removed selectively from the external portion of the contact surface so that there is less aluminum or aluminum alloy in the external portion than in the internal portion. As mentioned above, the aluminum or the aluminum alloy can give the valve seat good thermal conductivity and fused-adhesion ability. However, the aluminum or the aluminum alloy degrades the valve seat in terms of the wear resistance, and seizure resistance. Therefore, it is not preferred that the aluminum or the aluminum alloy exists in the external portion which forms the contact surface of the valve seat. Accordingly, the removal of the aluminum or the aluminum alloy can furthermore improve the performance of the valve seat.

The present cylinder head can be prepared in the following manner: a metallic cylinder head body is cast by an ordinary process. The resultant cylinder head body is thermal-sprayed to deposit a laminated substance on the surface where a valve seat is formed. The resulting laminated substance is machined to form a contacting surface. The present cylinder head is thus completed. The thermal-spraying operation is not particularly different from the ordinary one. Note that, however, it is needed to form a laminated substance whose laminating or depositing direction is inclined by from 0 to 60 degrees with respect to the contact surface.

A thermal-spraying gun is used for the thermal-spraying operation, and is usually connected with hoses. Thus, the movements of the thermal-spraying gun are limited relatively, and accordingly the thermal-spraying directions are restricted in most of the cases. Hence, it is practical that the thermal-spraying direction is parallel to the axial center line of a port, and that the thermal-spraying gun is moved to form a laminated substance in a circular manner along a circular configuration of a valve seat while keeping the thermal-spraying direction parallel to the axial center line of a port.

In order to make the deposition of a laminated substance easier, it is preferred that an internal surface, defining a port, is provided with a stepped portion which has a surface disposed perpendicularly to the thermal-spraying direction. The thermal-spraying is carried out onto the stepped portion to form a laminated substance thereon.

Moreover, the composition of a laminated substance, constituting the valve seat, can be varied continuously or step-wise to make a functionally gradient valve seat. However, such an arrangement is not practical, because the preparation therefor may be complicated considerably.

In addition, the aluminum or the aluminum alloy present in a friction surface (i.e., in the external portion of the contact surface of the valve seat) can be removed by the following processes: namely; by eluting out the aluminum elements with an alkali or acid; and by fusing and evaporating the aluminum elements with laser or radio-frequency heating. Note that the external portion of the contact surface can be preferably processed in a thickness of from 0.1 to 1.0 mm, furthermore preferably 0.2 mm, to remove the aluminum elements. As a result, the friction surface or the contact surface can be substantially free from aluminum alloy, and can be of superior wear resistance.

In the present cylinder head, the contact surface of the valve seat can be formed by ordinary machining or grinding as well.

BRIEF DESCRIPTION OF THE DRAWINGS

A more complete appreciation of the present invention and many of its advantages will be readily understood by reference to the following detailed description when considered in connection with the accompanying drawings and detailed specification, all of which forms a part of the disclosure.

DETAILED DESCRIPTION OF THE PREFERRED EMBODIMENTS

Figure 1:
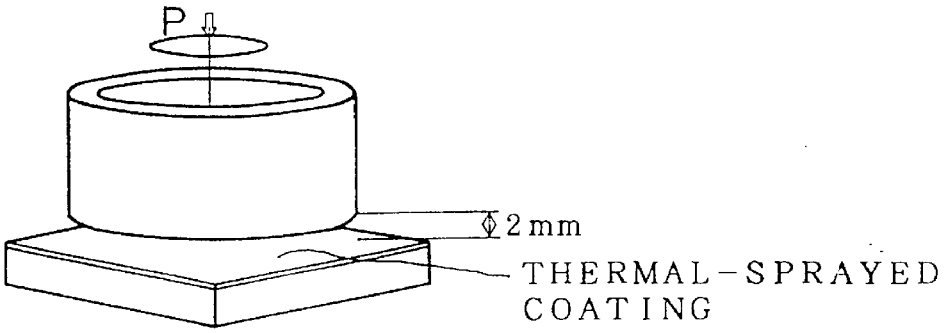
FIG. 1 is a schematic diagram for illustrating an adhesive wear test to which experimental examples were subjected.

Having generally described the present invention, a further understanding can be obtained by reference to the specific preferred embodiments which are provided herein for the purpose of illustration only and not intended to limit the scope of the appended claims.

Experimental Examples (Thermal-Spraying Treatment)

Twenty-two thermal-spraying materials, for instance, thermal-spraying material Nos. 1 through 22 as set forth in Table 1 below, were prepared.

Among the 22 thermal-spraying materials, 14 thermal-spraying materials, for example, thermal-spraying material Nos. 1 through 11, No. 16, No. 19, and No. 20 were a powder mixture which included two powders: namely; a powder to be turned into a matrix alloy, and a powder to be a lubricating and wear-resisting additive;

6 thermal-spraying materials, for example, thermal-spraying material Nos. 12 through 15, No. 17, and No. 21 were a powder mixture which included three powders: namely; a powder to be turned into a matrix alloy, a powder to be a lubricating and wear-resisting additive, and an aluminum alloy powder; and 2 thermal-spraying materials, for example, thermal-spraying material No. 18, and No. 22 included a single powder.

Specifically, an Fe-0.4%C alloy, SUS410L (as per Japanese Industrial Standard (hereinafter abbreviated to "JIS")), SUS430 (as per JIS), SUS410 (as per JIS), and SUS304 were turned into a matrix alloy, and had an average particle diameter of 35 μm, 38 μm, 32 μm, 42 μm, and 36 μm, respectively;

ferromolybdenum, ferrochromium, FeCrC, $Cr_2C_3$, $Fe_3C$, and used as lubricating and wear-resisting additives, and had an average particle diameter of 25 μm, 18 μm, 15 μm, 12 μm, 25 μm, and 15 μm, respectively; and an Al-12%Si was employed as the aluminum alloy powder, and had an average particle diameter of 80 μm.

In particular, thermal-spraying material No. 22 included a single powder of an iron-based sintered alloy (e.g., Fe-1%C-5%Mo-8.5%Co-15%Pb), and had an average particle diameter of 120 μm. Thermal spraying material No. 22 was prepared in the following manner: an iron powder, a graphite powder, a ferromolybdenum powder, and a cobalt powder, which had an average particle diameter of from 80 to 250 μm, were mixed, molded into a green preform, and sintered; and thereafter lead was infiltrated into the sintered preform.

Note that, before using the thermal-spraying materials which were prepared by mixing two or more powders, they were mixed uniformly by a type "V" mixer for 20 minutes. In addition to the arrangements of the 22 thermal-spraying materials, a volume % of independent raw powder materials with respect to a whole thermal-spraying material taken as 100% are also incorporated into Table 1.

TABLE 1

| Identi- | Matrix Alloy | | Lubricating and Wear-Resisting Additive | | Al Alloy | |
|---|---|---|---|---|---|---|
| fication | Species | Vol. % | Species | Vol. % | Species | Vol. % |
| 1* | Fe-0.4% C | 72% | FerroMo | 28% | None | None |
| 2* | " | 80% | " | 20% | None | None |
| 3* | " | 88% | " | 12% | None | None |
| 4* | " | 95% | " | 5% | None | None |
| 5 | SUS410L | 75% | " | 25% | None | None |
| 6 | SUS430 | 85% | " | 15% | None | None |
| 7* | Fe-0.4% C | 80% | " | 20% | None | None |
| 8* | " | 80% | FeCrC | 20% | None | None |
| 9* | " | 80% | $Cr_2C_3$ | 20% | None | None |
| 10* | " | 80% | $Fe_3C$ | 20% | None | None |
| 11* | " | 80% | WC | 20% | None | None |
| 12** | " | 72% | FerroMo | 18% | Al-12% Si | 10% |
| 13** | " | 64% | " | 16% | " | 20% |
| 14** | " | 56% | " | 14% | " | 30% |
| 15 | SUS410 | 64% | " | 16% | " | 20% |
| 16 | SUS304 | 80% | " | 20% | None | None |
| 17 | " | 64% | " | 16% | Al-12% Si | 20% |
| 18 | Fe-0.4% C | 100% | None | None | None | None |
| 19 | " | 98% | FerroMo | 2% | None | None |
| 20 | " | 60% | FeCrC | 40% | None | None |
| 21 | " | 52% | FerroMo | 13% | Al-12% Si | 35% |

TABLE 1-continued

| Identification | Matrix Alloy Species | Matrix Alloy Vol. % | Lubricating and Wear-Resisting Additive Species | Lubricating and Wear-Resisting Additive Vol. % | Al Alloy Species | Al Alloy Vol. % |
|---|---|---|---|---|---|---|
| 22 | [Fe-based Sintered Alloy (Fe-1% C-8.5% Co-15% Pb)] | | | | | |

Note (1): The thermal-spraying materials marked with * were for determining an optimum addition amount of the hard particles (or lubricating and wear-resisting additives).
Note (2): Excepting the portions resulting from the Al alloy, the thermal-spraying materials marked with ** had a structure which was similar to that of thermal-spraying material No. 2.

A plate made from AC2C (as per JIS) was used as a substrate to be thermal-sprayed. An "HVOF" thermal-spraying apparatus (or a "DJ" gun made by SULZER-METCO Co., Ltd.) was used as a thermal-spraying apparatus.

The conditions of the thermal-spraying operation were identical for all the thermal-spraying materials. Specifically, a propylene gas, an oxygen ($O_2$) gas, air, and the powdered thermal-spraying materials were supplied at a rate of 40 L/min., 42 L/min., 80 L/min., and 80 g/min., respectively. The resulting thermal-sprayed films had a thickness of 2.2 mm at maximum, and were subjected to chamfering. After the chamfering operation, the chamfered thermal-sprayed films had a thickness of 1.2 mm at maximum.

(Adhesive Wear Test)

As illustrated in FIG. 1, an adhesive wear test was carried out in a ring-on-plate manner: namely; a plate was hit by a ring repeatedly. The plate tested herein was the plate-shaped substrate on which the thermal-spraying materials of the experimental examples were thermal-sprayed. The ring, or a mating member, employed herein was made from SUH35 (as per JIS) which is known as a material for making engine valves, and had an outside diameter of 35 mm, an inside diameter of 25 mm, and a height of 6.5 mm. This adhesive wear test was carried out under the following conditions:

Temperature: 350° C.;

Load: 20 kgf;

Hitting Speed: 2 mm/sec.;

Repetition Speed: 120 times/min.;

Testing Atmosphere: in a nitrogen ($N_2$) gas; and

Testing Time: 30 min.

(Thrust-Collar Wear Test)

Figure 2:
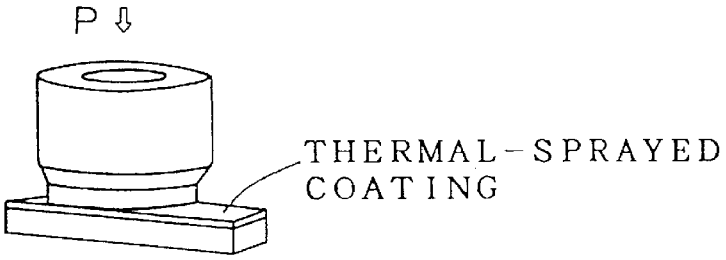
FIG. 2 is a schematic diagram for illustrating a thrust-collar wear (or sliding wear) test to which experimental examples were subjected.

A thrust-collar wear test was carried out by using a testing apparatus as illustrated in FIG. 2. The plate-shaped substrate, on which the thermal-spraying materials of the experimental examples were thermal-sprayed, was machined to a band-shaped member tested herein. The band-shaped member had a width of 5 mm, a length of 25 mm, and a height of 10 mm. A collar, or a mating member, employed herein was made from SUH35 (as per JIS), the same material used in the adhesive wear test above. The mating member contacted with the band-shaped member at the sliding surface. The sliding surface had an outside diameter of 20 mm, and an inside diameter of 10 mm. This thrust-collar wear test was carried out under the following conditions:

Temperature: 400° C.;

Load: 20 kgf;

Peripheral Speed: 0.3 mm/sec., (or Revolving Speed of Mating Member: 370 rpm);

Testing Atmosphere: in a nitrogen ($N_2$) gas; and

Testing Time: 20 min.

(Examination for Relationship between Angle of Contact Surface with respect to Depositing Direction and Adhesive Wear Depth)

Figure 3:
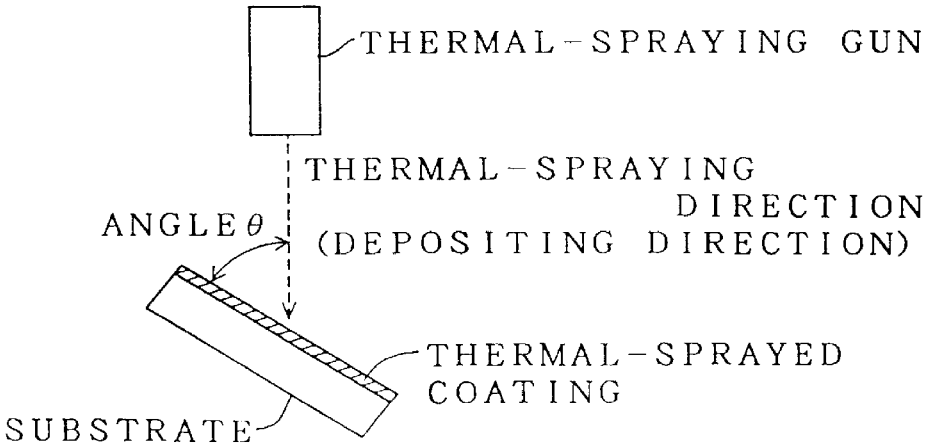
FIG. 3 is a schematic diagram for illustrating a thermal-spraying direction with respect to a substrate.

Thermal-spraying material No. 13 was selected, and was thermal-sprayed onto a surface of the plate-shaped substrates at 6 different thermal-spraying angles, for instance, at an angle of 15, 30, 45, 60, 75, and 90 degrees, with respect to the surface to be thermal-sprayed, respectively. Thereafter, the resultant thermal-sprayed coatings were chamfered on the surface so that it had a predetermined thickness from the surface of the plate-shaped substrates to be thermal-sprayed. Experimental contact surfaces were thus prepared. Note that, even after the chamfering operation, the thermal-spraying angle was equal to the angle of the contact surface with respect to the depositing direction, because the thermal-spraying direction was identical with the laminating direction of the resultant laminated substances. FIG. 3 schematically illustrates the relationship between the thermal-spraying angle with respect to the plate-shaped substrate and the depositing direction.

Figure 4:
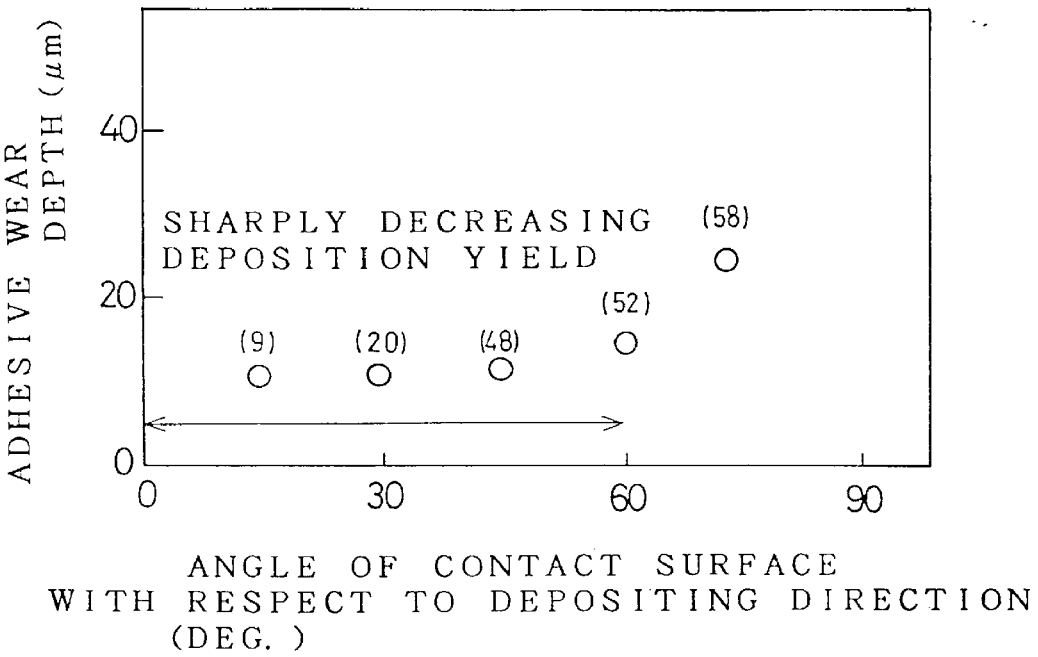
FIG. 4 is a scatter diagram for illustrating the relationship between the adhesive wear depth of thermal-sprayed laminated substances and the angle of contact surfaces with respect to the depositing direction of thermal-sprayed laminated substances, relationship which was exhibited by experimental examples.

FIG. 4 illustrates the relationship between the angle of the contact surfaces with respect to the depositing direction of the laminated substances and the adhesive wear depth. It is understood from FIG. 4 that the adhesive wear depth enlarges when the angle of the contact surfaces with respect to the depositing direction of the laminated substances increases. In particular, it is appreciated therefrom that the adhesive wear depth sharply enlarges when the angle of the contact surfaces with respect to the depositing direction of the laminated substances exceeds 60 degrees. As a result, it was found that the angle of the contact surface with respect to the depositing direction of the laminated substance can preferably be less than 60 degrees. Note that the double-headed arrow of FIG. 4 specifies the range of the angle of the contact surface with respect to the depositing direction of the laminated substance, range which is claimed by the present invention.

Moreover, the parenthesized numbers of FIG. 4 designate a deposition yield of the thermal-spraying material. It is apparent from FIG. 4 that the deposition yield decreases as the thermal-spraying angle decreases (or as the thermal-spraying direction approaches parallel to the surface to be thermal-sprayed). In view of the deposition yield, it is preferred that the thermal-spraying can be carried out perpendicular to the surface to be thermal-sprayed. Note that, when an inclined thermal-spraying operation was carried out at an angle of 30 degrees or less, the deposition yield was 20% or less to considerably deteriorate the thermal-spraying efficiency.

(Examination for Relationship between Volume Content of Hard Particles in Laminated Substance and Wear of Laminated Substance, or Wear of Mating Member)

Figure 5:
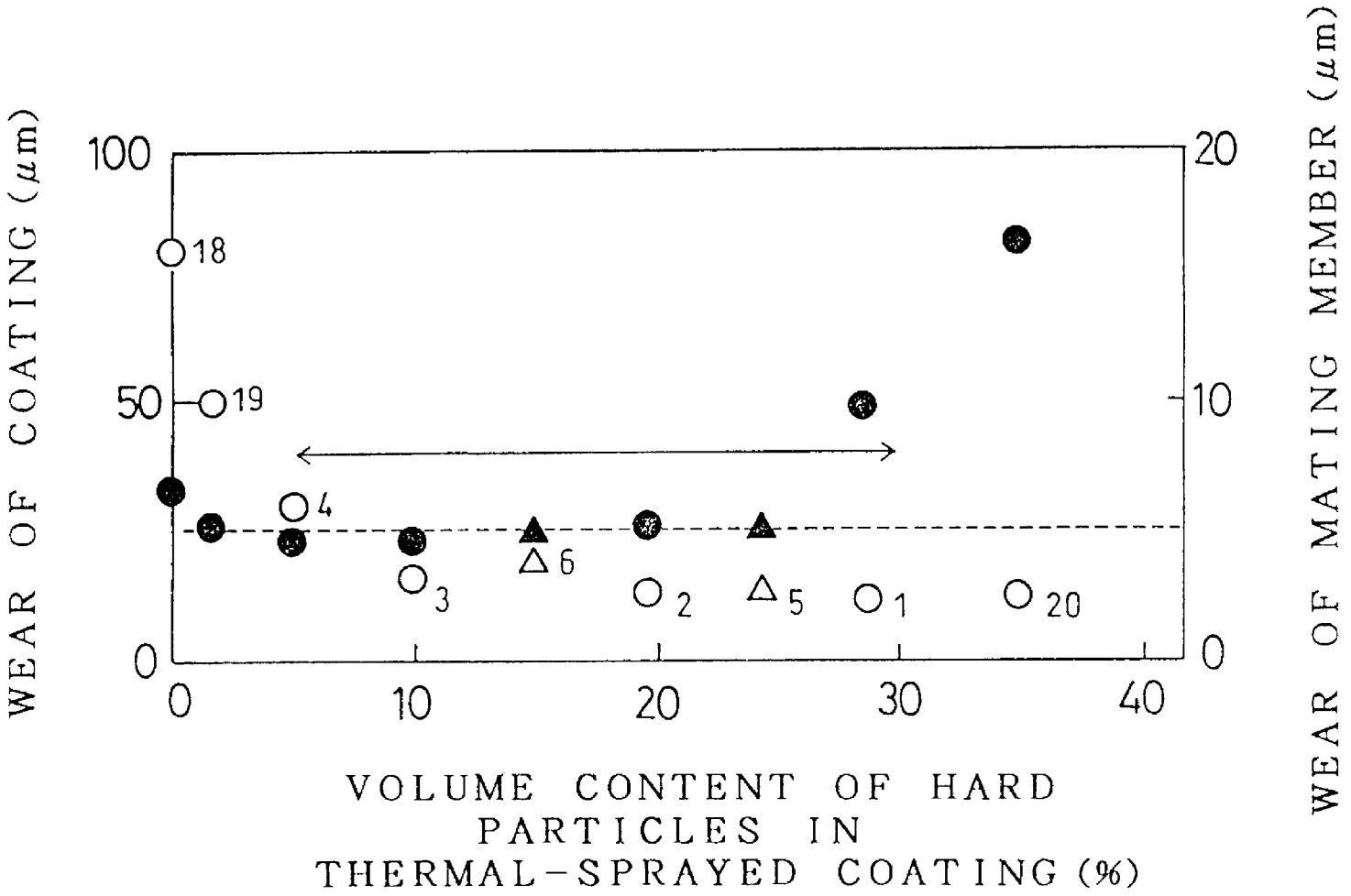
FIG. 5 is a scatter diagram for illustrating the relationship between the wear of thermal-sprayed laminated substances and the volume content of thermal-spraying materials (or hard particles) in thermal-sprayed laminated substances, and the relationship between the wear of mating members and the volume content of thermal-spraying materials (or hard particles) in thermal-sprayed laminated substances, relationships which were exhibited by experimental examples.

Except that ferromolybdenum was thermal-sprayed as a thermal-spraying material (or hard particles) onto a band-shaped test member whose matrix was Fe-0.4%C or SUS (as per JIS), and that the angle of the contact surface with respect to the depositing direction of the laminated substance was fixed at 45 degrees, the thrust-collar wear test was carried out in the same manner as described above. FIG. 5 illustrates the resulting relationships between the volume % of the hard particles and the wear of the laminated substances which were formed by thermal-spraying the hard particles, or the wear of the mating member. In FIG. 5, the blank circles (○) and blank triangles (Δ) specify the wear of the laminated substances; the solid circles (●) and solid triangles (▲) specify the wear of the mating member; and the numerals put on the right-hand-side of the blank circles (○) and blank triangles (Δ) specify the identification numbers for the thermal-spraying materials set forth in Table 1 above. Note that the blank circles (○) and solid circles (●) specify the data on the band-shaped member whose matrix was Fe-0.4%C; and the blank triangles (Δ) and solid triangles (▲) specify the data on the band-shaped member whose matrix was SUS (as per JIS).

It is understood from FIG. 5 that the wear of the laminated substances decreases when the volume % of the hard particles increases. On the contrary, the wear of the mating member increases when the volume % of the hard particles increases. It is seen from FIG. 5 that a preferred volume % of the hard particles falls in a range of from 5 to 30% where both of the laminated substances and mating member wear less.

(Examination for Relationship between Specific Hard Particles in Laminated Substance and Wear of Laminated Substance)

Figure 6:
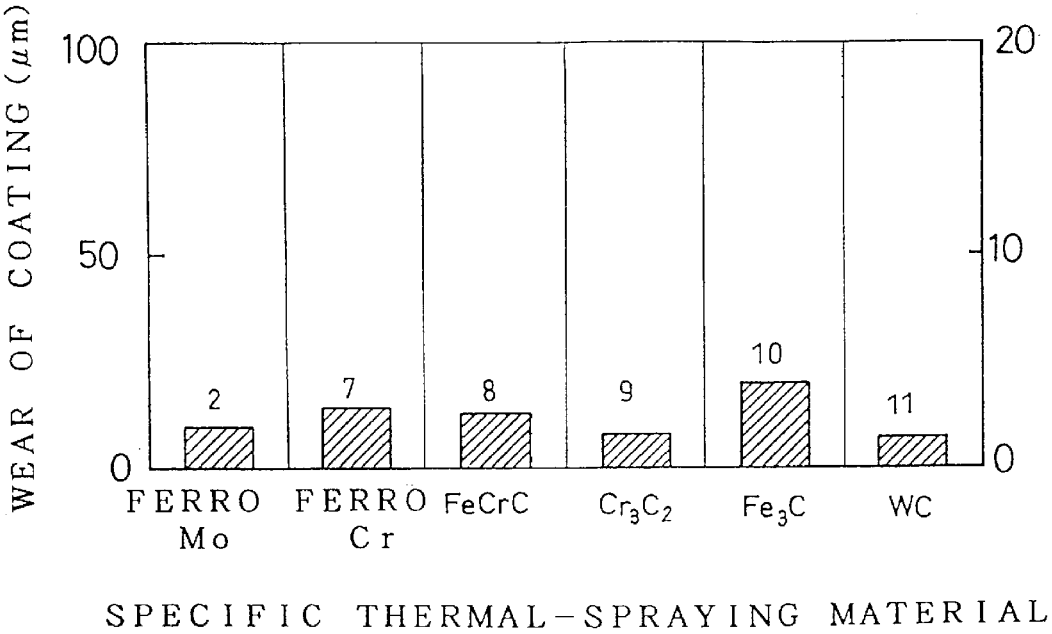
FIG. 6 is a bar chart for illustrating the relationship between the wear of thermal-sprayed laminated substances and the volume content of specific thermal-spraying materials (or hard particles) in thermal-sprayed laminated substances, relationship which was exhibited by experimental examples.

Except that a variety of thermal-spraying materials (or hard particles) were thermal-sprayed onto a band-shaped test member which included Fe-0.4%C as the matrix in an amount of 80% by volume, and that the angle of the contact surface with respect to the depositing direction of the laminated substance was fixed at 45 degrees, the thrust-collar wear test was carried out in the same manner as described above. FIG. 6 illustrates the wear of the laminated substances. In FIG. 6, the numerals put on the top of the bars specify the identification numbers for the thermal-spraying materials set forth in Table 1 above.

It is appreciated from FIG. 6 that all of the hard particles tested herein remarkably effected to reduce the wear of the laminated substances. Among them, the ferromolybdenum, $Cr_2C_3$, and WC reduced the wear most effectively.

(Examination for Relationship between Volume Content of Al Alloy Particles in Laminated Substance and Wear, Adhesive Wear Depth, or Thermal Expansion Coefficient of Laminated Substance)

Figure 7:
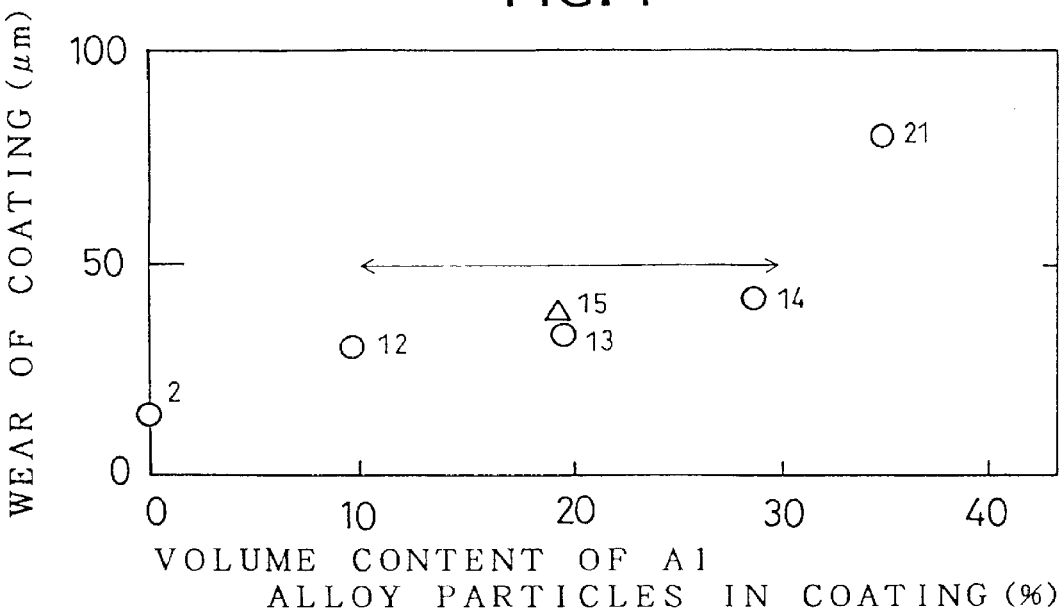
FIG. 7 is a scatter diagram for illustrating the relationship between the wear of thermal-sprayed laminated substances and the volume content of Al alloy particles in thermal-sprayed laminated substances, relationship which was exhibited by experimental examples.
Figure 8:
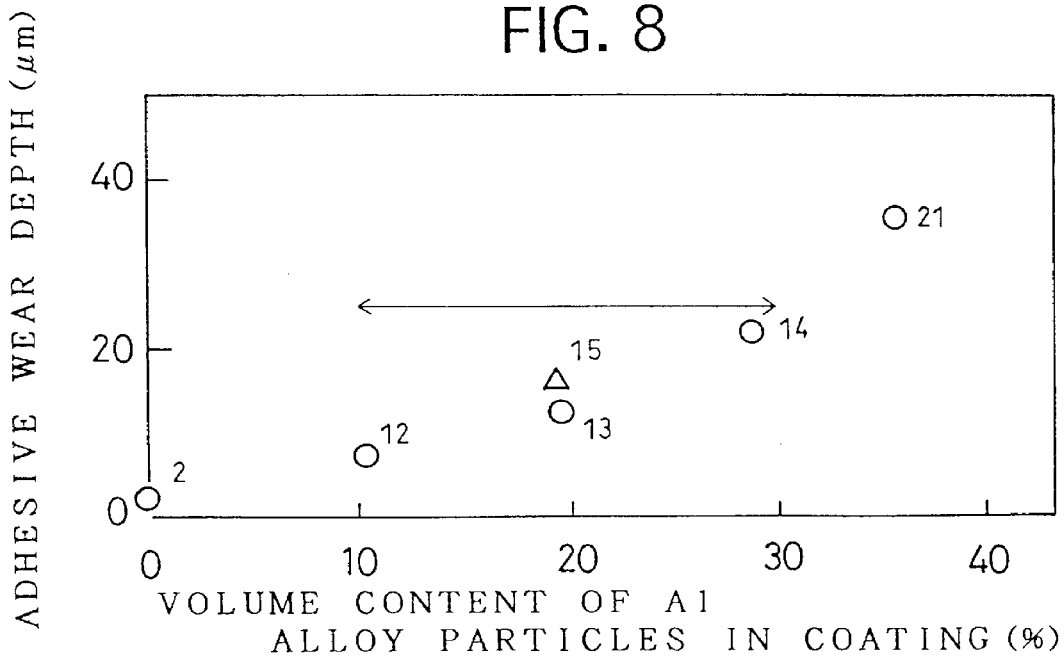
FIG. 8 is a scatter diagram for illustrating the relationship between the adhesive wear depth of thermal-sprayed laminated substances and the volume content of Al alloy particles in thermal-sprayed laminated substances, relationship which was exhibited by experimental examples.
Figure 9:
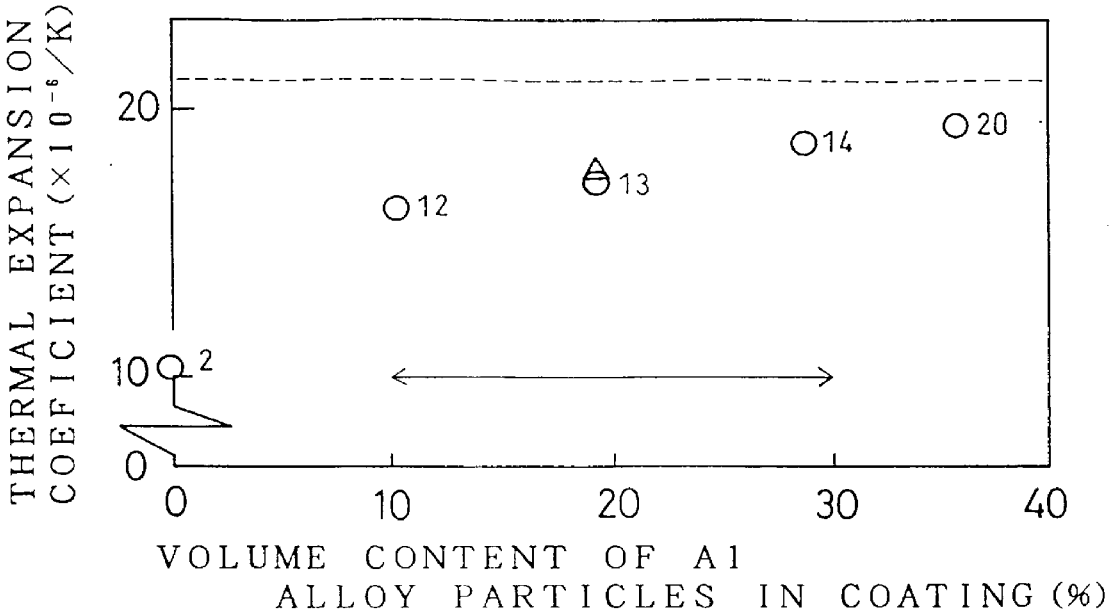
FIG. 9 is a scatter diagram for illustrating the relationship between the thermal expansion coefficient of thermal-sprayed laminated substances and the volume content of Al alloy particles in thermal-sprayed laminated substances, relationship which was exhibited by experimental examples.

FIG. 7 illustrates the relationship between the volume content of Al alloy particles in laminated substances, which were formed by thermal-spraying to constitute a valve seat, and the wear of the laminated substance. FIG. 8 illustrates the relationship between the volume content of Al alloy particles in the laminated substances and the adhesive wear thereof. FIG. 9 illustrates the relationship between the volume content of Al alloy particles in the laminated substances and the thermal expansion coefficient thereof. In this examination, the laminated substances tested herein included Fe-0.4%C as the matrix, and ferromolybdenum as the hard particles in a fixed amount of 80% by volume, and 20% by volume, respectively, and Al alloy particles were added to the laminated substance in various amounts. In FIGS. 7, 8, and 9, the numerals put on the right-hand-side of the blank circles (○) and blank triangle (Δ) specify the identification numbers for the thermal-spraying materials set forth in Table 1 above. Note that the blank circles (○) specify the data on the substrate whose matrix was Fe-0.4%C; and the blank triangle (Δ) specifies the data on the substrate whose matrix was SUS (as per JIS).

It is understood from FIG. 7 that the wear of the laminated substances increases when the volume % of Al alloy particles increases. When the volume % of Al alloy particles is less than 30%, the wear increment of the laminated substances is relatively small. When the volume % of Al alloy particles exceeds 40%, the wear of the laminated substances increases sharply. Thus, in terms of the wear of the laminated substances, it is preferred that the volume % of Al alloy particles is less than 30%, further preferably falls in a range of from 10 to 30% by volume.

FIG. 8 illustrates the relationship between the volume content of Al alloy particles in the laminated substances and the adhesive wear thereof The adhesive wear depth of the laminated substances is correlated with the volume of Al alloy particles therein, in the same manner as the wear of the laminated substances is correlated with the volume content of Al alloy particles therein: namely; when the volume % of Al alloy particles is less than 30%, the adhesive wear depth increment of the laminated substances is relatively small; and when the volume % of the Al alloy particles exceeds 40%, the adhesive wear depth of the laminated substances increases sharply. As justified by the wear of the laminated substances, in terms of the adhesive wear depth thereof it is likewise preferred that the volume % of Al alloy particles is less than 30%, further preferably falls in a range of from 10 to 30% by volume.

FIG. 9 illustrates the relationship between the volume content of Al alloy particles in the laminated substances and the thermal expansion coefficient thereof It is apparent that, as the volume % of Al alloy particles increases, the thermal expansion coefficient of the laminated substances increases to approach to that of AC2C (as per JIS) aluminum alloy which is widely used in automotive cylinder heads in general. Note that the thermal expansion coefficient of AC2C (as per JIS) is designated by the dotted line of FIG. 9. When the difference between the thermal expansion coefficient of cylinder head bodies and that of the laminated substances, which are fused and deposited on the surface of cylinder head bodies, is small, it implies that the laminated substances exhibit strong resistance against thermal shocks. Hence, when a cylinder head body is made from an Al alloy, it is preferred that a laminated substance includes Al alloy particles which are compounded therein.

Thus, in FIGS. 7 through 9, the range designated by the double-headed arrows specifies a preferred volume content of Al alloy particles which are compounded in a laminated substance.

(Conclusions Derived from Experimental Examples)

According to the above-described experimental examples, it is appreciated that the angle of contact surface with respect to the depositing direction of laminated substance can preferably fall in a range of from 0 to 60 degrees. Further, it is realized that a thermal-spraying material (or hard particles) can preferably be involved in an amount of from 5 to 30% by volume in a matrix constituting a laminated substance. Furthermore, it is understood that Al alloy particles can preferably be compounded in an amount of from 10 to 30% by volume in a laminated substance.

Preferred Embodiment

Figure 10:
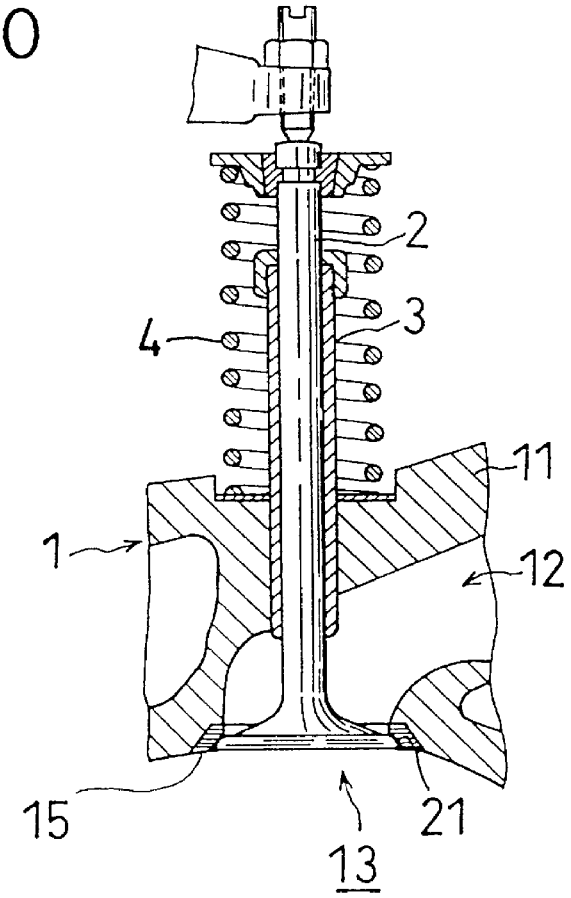
FIG. 10 is a cross-sectional view for illustrating a major portion of a cylinder head according to a preferred embodiment of the present invention.

FIG. 10 illustrates a major portion of a cylinder head 1 according to a preferred embodiment of the present invention in cross-section. As illustrated in the drawing, the cylinder head 1 includes a cylinder head body 11, and a valve seat 15 which is one of the features of the present invention. The valve seat 15 is disposed on the side of a combustion chamber 13: namely; it is disposed at one of the opposite ends of an inlet or outlet port 12 which opens to the combustion chamber 13. Further, an engine valve 2 is assembled in the cylinder head 1. Specifically, the engine valve 2 is fitted into a valve guide 3 which is built in the cylinder head body 11, and is urged by a coiled spring 4 in a direction closing the inlet or outlet port 12. Furthermore, the engine valve 2 is provided with a valve face 21 which contacts with the valve seat 15 so as to close the inlet or outlet port 12.

Figure 11:
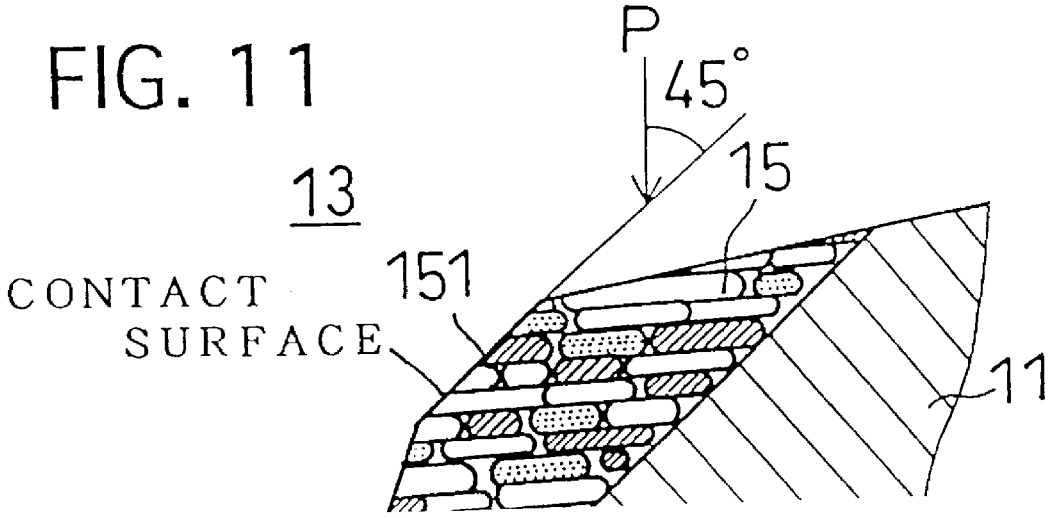
FIG. 11 is an enlarged cross-sectional view for illustrating a valve seat in the cylinder head according to the preferred embodiment.

FIG. 11 schematically illustrates a major portion of the cylinder head 1 according to the preferred embodiment in enlarged cross-section. The cylinder head 1 includes a cylinder head body 11, and the valve seat 15. The cylinder head 11 is made from AC2C (as per JIS). AC2C is one of aluminum casting alloys which include Cu in an amount of from 2 to 4% by weight, Si in an amount of from 5 to 7% by weight, Mg in an amount of from 0.2 to 0.4% by weight, Mn in an amount of from 0.2 to 0.4% by weight, and the balance of Al. The valve seat 15 is formed of a laminated substance which is prepared by depositing a thermal-spraying material. For example, the valve seat 15 includes Fe-0.4%C in an amount of 64% by volume, ferromolybdenum in an amount of 16% by volume, and Al-12%Si in an amount of 20% by volume. The Fe-0.4%C constitutes a matrix of the laminated substance, the ferromolybdenum constitutes a lubricating and wear-resisting material, and the Al-12%Si constitutes Al alloy particles. In addition, the valve seat 15 is provided with a contact surface 151 with which the valve face 21 of the engine valve 2 contacts, and is inclined by 45 degrees with respect to a depositing direction "P" of the laminated substance.

Figure 12:
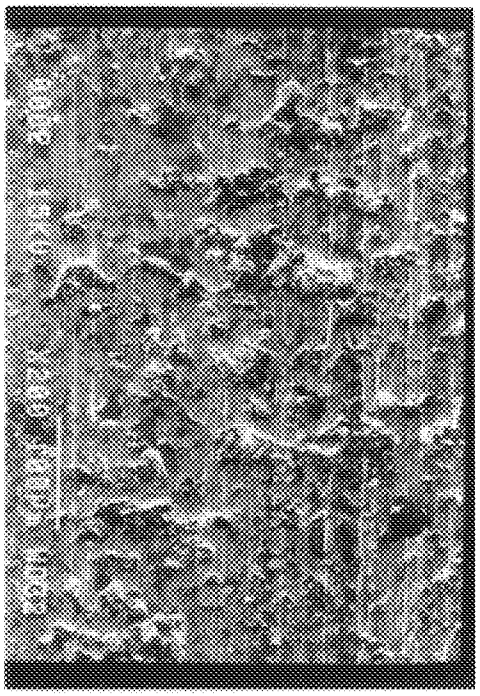
FIG. 12 is a photograph for showing the metallic structure of a contact surface of the valve seat in the cylinder head according to the preferred embodiment, photograph which was taken by a scanning electron microscope.

FIG. 12 is a photograph for showing a superficial portion of the valve seat 15 involving the contact surface 151. The photograph was taken by a scanning electron microscope. As shown by the photograph, the superficial portion had a metallic structure in which the Al alloy particles had been existed, but from which they were removed.

Figure 14:
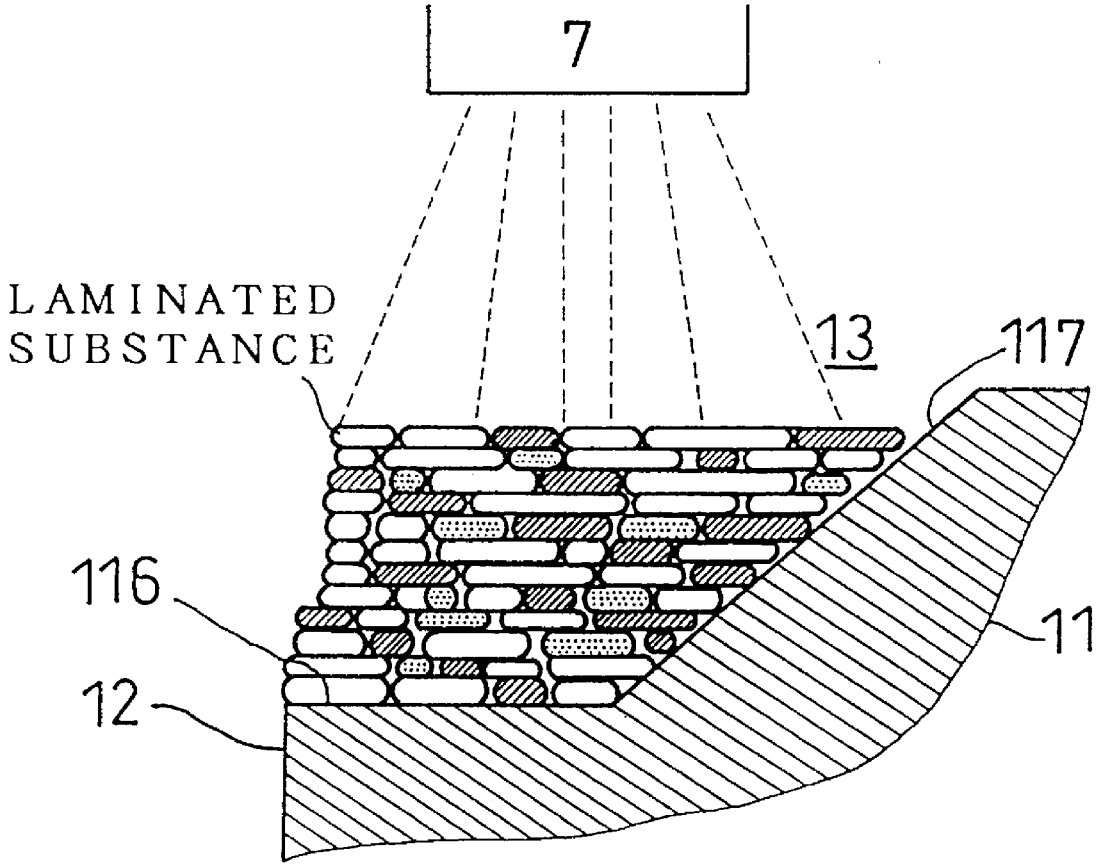
FIG. 14 is an enlarged cross-sectional view for schematically illustrating the thermal-spraying process in operation for preparing the valve seat in the cylinder head according to the preferred embodiment.

As illustrated in FIG. 14, the cylinder head body 11 is provided with a stepped portion on the side of the combustion chamber 13 to which one of the opposite ends of the inlet or outlet port 12 opens. The stepped portion is defined by a ring-shaped bottom surface 116, and an inclined surface 117. The ring-shaped bottom surface 116 is disposed perpendicular to the axial center line of the inlet or outlet port 12, and surrounds the inlet or outlet port 12. The inclined surface 117 extends slantingly from an outer peripheral end of the bottom surface 116 in a bowl-like manner. In the cylinder head 1 according to the preferred embodiment, the stepped portion was formed by machining after the cylinder head body 11 is molded by low-pressure casting. Note that, however, the stepped portion can be formed simultaneously with the casting of the cylinder head body 11.

Figure 13:
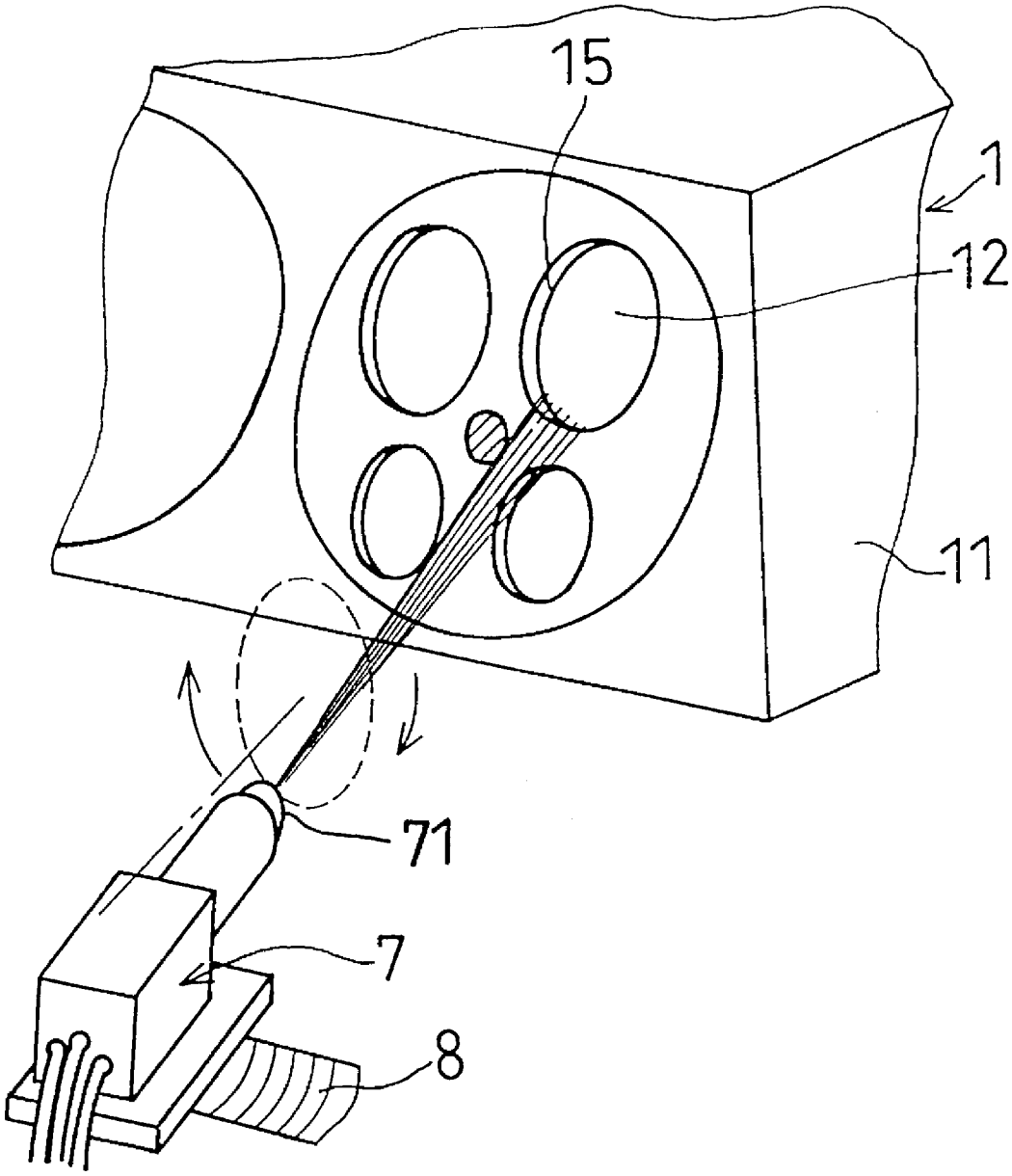
FIG. 13 is a schematic diagram for illustrating a thermal-spraying process for preparing the valve seat in the cylinder head according to the preferred embodiment.

As illustrated in FIG. 13, when the valve seat 15 is formed of the laminated substance by thermal-spraying, the cylinder head body 11 is placed so that the inlet or outlet port 12 faces a thermal-spraying gun 7. The thermal-spraying gun 7 is provided with a nozzle 71 which is directed to the bottom surface 116 of the stepped portion in the cylinder head body 11. Moreover, the thermal-spraying gun 7 is held on a thermal-spraying gun rotator 8, and is driven rotationally by the rotor 8 so that its nozzle 71 goes around along the ring-shaped bottom surface 116 of the stepped portion.

Indeed, the cylinder head body 11 was kept in the above-described state. Then, thermal-spraying material No. 13 recited in Table 1 above was thermal-sprayed onto the cylinder head body 11 while rotating the thermal-spraying gun 7 along the ring-shaped bottom surface 116. As a result, the laminated substance was prepared in which the particles of thermal-spraying material No. 13 were fused, and in which they were deposited on the stepped portion as flakes.

Thereafter, the resultant laminated substance was machined on the inner peripheral surface so as to form the contact surface 151 which was inclined by 45 degrees with respect to the depositing direction "P" of the laminated substance. Moreover, as illustrated in FIG. 11, the inner peripheral surface of the laminated surface was machined so as to give the contact surface 151 an inclined surface on the side of the inlet or outlet port 12, and another inclined surface on the side of the opening of the contact surface 151. The inlet-or-outlet-port-side inclined surface was inclined by 15 degrees with respect to the depositing direction "P" of the laminated substance, and the contact-surface-opening-side inclined surface was inclined by 60 degrees with respect to the depositing direction "P" of the laminated substance.

Finally, the inclined surfaces, including the contact surface 151, were brought into contact with an aqueous solution of sodium hydroxide, thereby eluting out the Al alloy particles which were exposed on the inclined surfaces. The valve seat 15 was thus prepared, and thereby the cylinder head 1 according to the preferred embodiment was completed.

In the cylinder head 1 according to the preferred embodiment, the valve seat 15 was formed of the laminated substance which was prepared by thermal-spraying, and in which the thermal-spraying particles constituting thermal-spraying material No. 13 were deposited as flakes. Moreover, the contact surface 151 was constituted by the end surface of the flaky thermal-spraying particles which were inclined by 45 degrees with respect to the depositing direction "P" of the laminated substance. Hence, the cylinder head 1 according to the preferred embodiment exhibited high wear resistance, and was of good thermal conductivity.

In particular, the ferromolybdenum particles were compounded in thermal-spraying material No. 13 as set forth in Table 1, and worked as a lubricating and wear-resisting additive in the valve seat 15. Accordingly, the valve seat 15 was less likely to be subjected to wear and to the adhesive wear which were caused by the material constituting the engine valve 2. Further, the Al alloy particles were compounded in thermal-spraying material No. 13. Consequently, the valve seat 15 was strongly bonded with the cylinder head body 11. Furthermore, the Al alloy particles were eluted out of the superficial portion of the valve seat 15 involving the contact surface 151. As a result, the valve seat 15 was inhibited from deteriorating in terms of the wear resistance, for instance, the adhesive wear resistance, and the like.

All in all, the cylinder head 1 according to the preferred embodiment exhibited a good characteristic for cooling engines, and was of excellent wear resistance.

Having now fully described the present invention, it will be apparent to one of ordinary skill in the art that many changes and modifications can be made thereto without departing from the spirit or scope of the present invention as set forth herein including the appended claims.

What is claimed is:

1. A cylinder head for an internal combustion engine, comprising:

a metallic cylinder head body provided with an inlet port, and an outlet port, the inlet port having opposite ends, and being opened and closed by an inlet valve, the outlet port having opposite ends, and being opened and closed by an outlet valve; and a valve seat disposed at one of the ends of at least one of the inlet port and the outlet port, having a contact surface being contacted with and separated from at least one of the inlet valve and the outlet valve, and formed of a laminated substance, the laminated substance including flakes formed by thermal spraying a mixture of at least two groups of particles in a predetermined thermal spraying direction, the contact surface inclined by an angle of from 0 to 60 degrees with respect to the thermal spraying direction.

2. The cylinder head according to claim 1, wherein the contact surface is inclined by an angle of from 30 to 60 degrees with respect to the thermal spraying direction.

3. The cylinder head according to claim 1, wherein:

said metallic cylinder head body is formed of an aluminum alloy; and said valve seat is formed of at least one material selected from the group consisting of a carbon steel and an alloy steel whose matrix is hardened by martensitic transformation.

4. The cylinder head according to claim 3, wherein said valve seat includes a matrix in which at least one material selected from the group consisting of carbide and an iron-based compound is included in an amount of from 5 to 30% by volume, and the material has an average particle diameter of from 50 $\mu$m or less.

5. The cylinder head according to claim 4, wherein the carbide is at least one material selected from the group consisting of FeCrC, $Cr_2C_3$, $Fe_3C$, and WC.

6. The cylinder head according to claim 4, wherein the iron-based compound is at least one material selected from the group consisting of ferromolybdenum, and ferrochromium.

7. The cylinder head according to claim 3, wherein said valve seat includes a matrix in which at least one material selected from the group consisting of aluminum and an aluminum alloy is included in an amount of from 10 to 30% by volume.

8. The cylinder head according to claim 7, wherein:

the contact surface of said valve seat includes an external portion, and an internal portion; and the material selected from the group consisting of aluminum and an aluminum alloy is selectively removed from the external portion so that the amount of material in the external portion is less than the amount of material in the internal portion.

9. The cylinder head according to claim 8, wherein the material is selectively removed by at least one process selected from the group consisting of eluting with at least one of an acid and an alkali, fusing and evaporating with laser, and fusing and evaporating with radio-frequency heating.

10. The cylinder head according to claim 8, wherein the external portion is processed in a thickness of from 0.1 to 1.0 mm.

11. The cylinder head according to claim 1, wherein at least one of the inlet port and the outlet port is provided with a stepped portion on which the laminated substance is deposited, and which includes a ring-shaped bottom surface, and an inclined surface, the ring-shaped bottom surface having an outer peripheral end, and disposed substantially perpendicular to an axial center line of at least of the inlet port and the outlet port, the inclined surface extending slantingly from the outer peripheral end of the ring-shaped bottom surface in a bowl-like manner.

12. The cylinder head according to claim 1, wherein the laminated substance is machined to form the contact surface.

13. The cylinder head according to claim 1, wherein the contact surface is provided with opposite sides; and the opposite sides are inclined with respect to the thermal spraying direction.

* * * * *

UNITED STATES PATENT AND TRADEMARK OFFICE

CERTIFICATE OF CORRECTION

PATENT NO. : 5,829,404

DATED : November 3, 1998

INVENTOR(S) : Mori et al.

It is certified that error appears in the above-indentified patent and that said Letters Patent is hereby corrected as shown below:

Claim 11, column 16, line 20, insert --one-- after "at least"

Signed and Sealed this

Second Day of March, 1999

*Attest:*

*Attesting Officer*

Q. TODD DICKINSON

*Acting Commissioner of Patents and Trademarks*